US006216912B1

(12) United States Patent
Keung et al.

(10) Patent No.: US 6,216,912 B1
(45) Date of Patent: Apr. 17, 2001

(54) PUMP DISPENSER HAVING SHROUD LOCKING MEANS

(75) Inventors: Wing-Kwong Keung, Perrysburg; Scotty Ferrell, Put-in-Bay; Gennaro R. Martire, Toledo, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/426,829

(22) Filed: Oct. 25, 1999

(51) Int. Cl.[7] ..... B67B 7/00
(52) U.S. Cl. ..... 222/1; 222/383.1
(58) Field of Search ..... 222/323, 324, 222/383.1, 207, 182; 239/333

(56) References Cited

U.S. PATENT DOCUMENTS 4,350,298 * 9/1982 Tada ..... 239/333
5,050,779 * 9/1991 Knickerbocker ..... 222/153
5,172,836 * 12/1992 Warner .
5,366,121 * 11/1994 Foster et al. .
5,706,984 * 1/1998 Tada et al. ..... 222/182
5,749,501 * 5/1998 Maas et al. .
5,890,632 * 4/1999 Chalupsky et al. ..... 222/383.1

* cited by examiner

*Primary Examiner*—Kevin Shaver
*Assistant Examiner*—Melvin A. Cartagena

(57) ABSTRACT

Dispenser pump shroud has forward T-shaped tongue which slides up incline on rails atop the pump body distorting the nozzle cap and snaps down in front of the forward end of rails leaving an upward hook extending through an opening in the cap.

6 Claims, 5 Drawing Sheets

PUMP DISPENSER HAVING SHROUD LOCKING MEANS

FIELD OF THE INVENTION

This invention relates to a pump dispenser of the type in which a pump body is covered by an open-fronted shroud slid forward over the pump body to a locked position.

BACKGROUND OF THE INVENTION

The Chalupsky et al patent 5,890,632 issued Apr. 6, 1999 discloses a pump dispenser in which an open-fronted shroud has channels extending down from its top wall and downward wedges, both of which engage flanges on the pump body to hold the shroud on the body. Other patents disclose means for holding the shroud on the body. Examples are the Tada et al patent 5,706,984 and Maas et al 5,799,501.

SUMMARY OF THE INVENTION

The invention is, of course, described in the claim language below. Briefly, the invention is a pump dispenser comprising a pump body with attached shroud of the type described in the Chalupsky et al patent above. The shroud has a forward tongue on its front end which rides on rails extending upward from the pump body. Forward portions of the rails are inclined upwardly and have a vertical front end. The tongue is "T"-shaped and carries a central upward barb.

In assembly, the open-fronted shroud is brought forward over the pump body with the "T"-shaped tongue riding on the rails. As the "T"-shaped tongue engages the upwardly inclined portion, it distorts the top wall of the nozzle cap. Subsequently, when the side wings of the T-shaped tongue come to the vertical front end, the tongue snaps downward, leaving the upward barb in an opening in the top wall of the nozzle cap. This arrangement assures secure placement of the shroud on the pump body.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
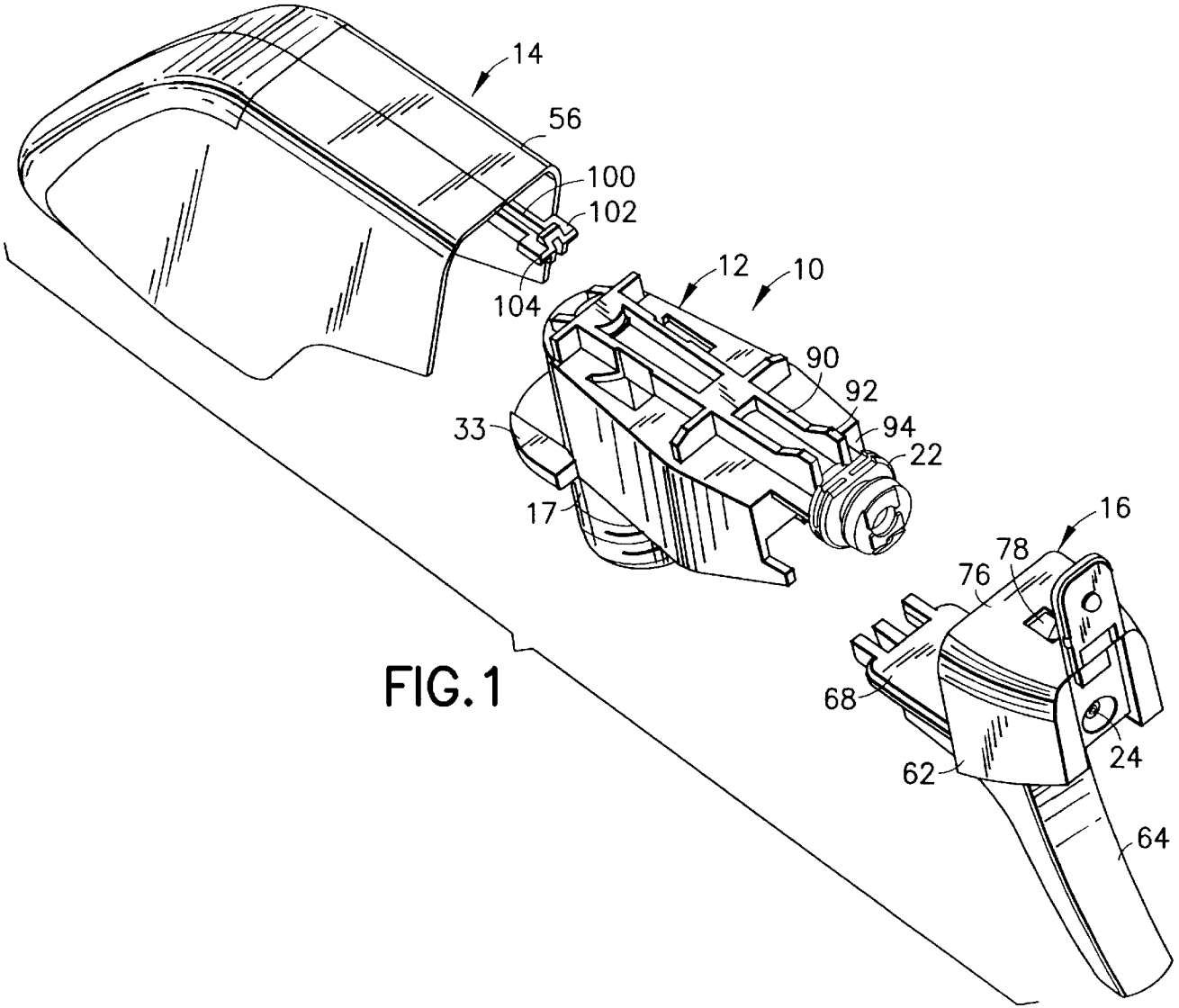
FIG. 1 is an exploded perspective view of a pump dispenser embodying the invention.

A pump dispenser embodying the invention is generally designated 10 in FIG. 1. It comprises a pump body 12 and shroud 14 and a nozzle cap/trigger 16.

Figure 1A:
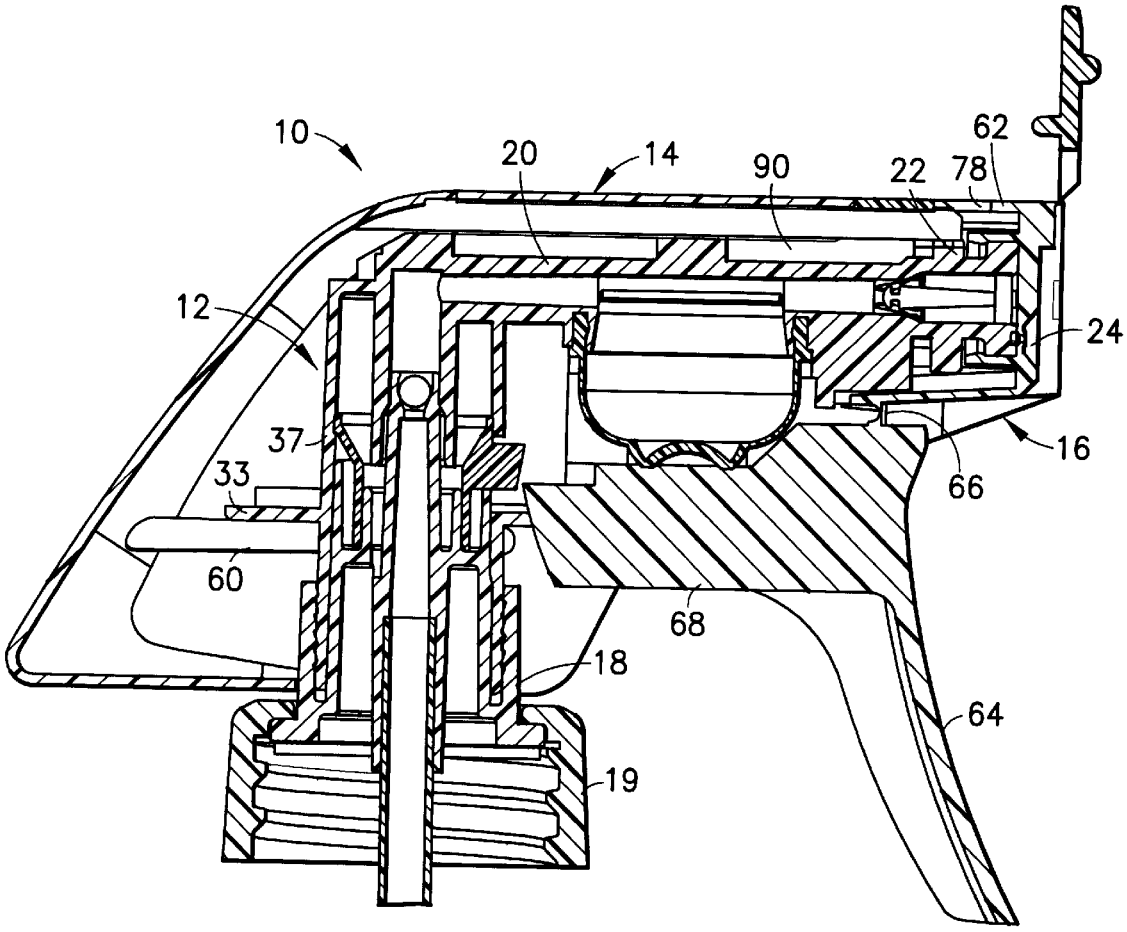
FIG. 1A is a centerline vertical sectional view of its assembled pump.

The pump body may be of the type disclosed in U.S. Pat. No. 5,603,434 issued Feb. 18, 1997 to von Schuckmann which disclosure is incorporated hereinto by reference. It comprises (FIG. 1A) a tubular support 17 which is secured to a container (not shown) by a spool-like retainer 18 and by a closure 19 to which the retainer 18 is swivelly mounted. The rear end of the tubular support 17 is formed with a rearward shelf 33. To the top of the tubular support 17 is disposed the pump 20 and a forward fluid conduit 20A which terminates in a nozzle fitting 22. Inlet and outlet check valves are provided as shown, the inlet being connected to a dip tube into the container (not shown). The nozzle fitting receives the nozzle cap trigger unit 16 which has the outlet orifice 24 equipped with the usual swirl chamber.

Figure 2:
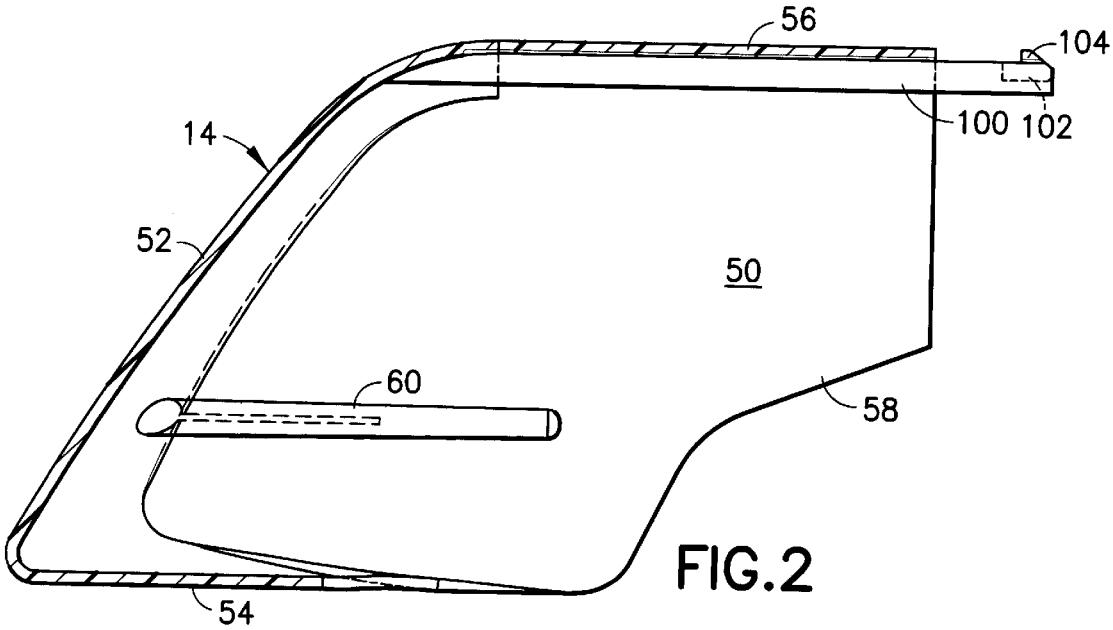
FIG. 2 is a centerline sectional view of the shroud.

The shroud 14 (FIG. 2) comprises side walls 50, a sloping rear end wall 52, a connected bottom wall 54 and a top wall 56. The front 58 is open to receive the pump body 12. A shoulder 60 is integrally formed with the adjacent walls of the shroud.

Figure 3:
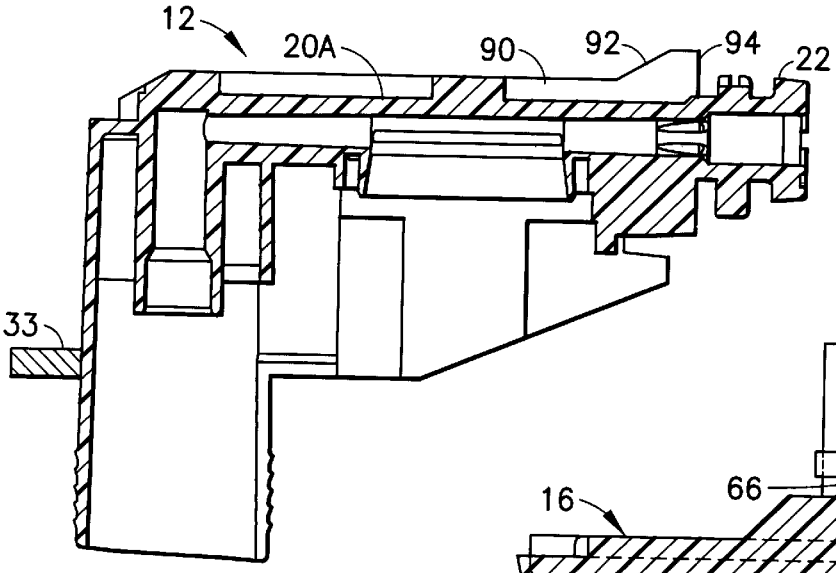
FIG. 3 is a center line vertical sectional view of the pump body.
Figure 4:
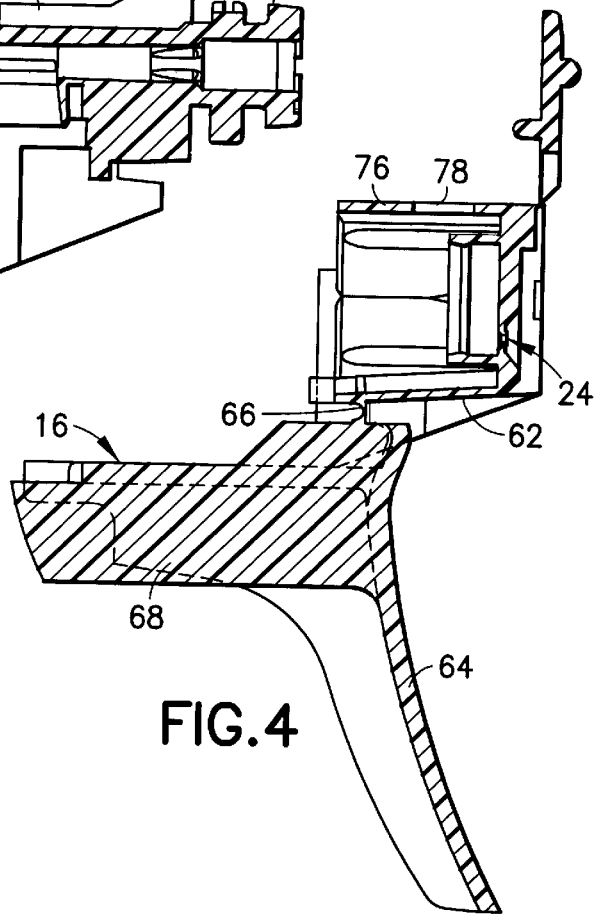
FIG. 4 is a center line vertical sectional view of the nozzle cap/trigger.

The nozzle cap/trigger unit 16 (FIG. 3), molded integrally of a resilient plastic, comprises (FIG. 4) the cap 62 and the trigger 64 hingedly connected by a living hinge 66. As shown, the nozzle cap 62 is formed with a top wall 76 which has a suitable latch opening 78 therein. The wall 76 is resilient. The trigger 64 has a rearwardly extending arm 68 to work the pump 20.

Figure 5A:
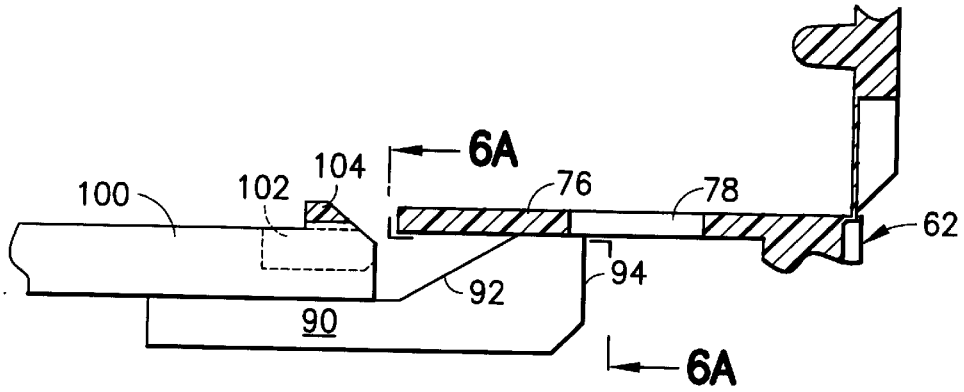
FIGS. 5A, B, C and D are progressive views showing the forward tongue of the shroud in the process of locking the shroud to the pump body.

Extending along the top of the fluid conduit 20A (FIG. 1A) are a pair of spaced rails 90. As best shown in FIG. 5A, the rails have parallel upward inclines 92 adjacent their front ends and vertical front ends 94.

The shroud 14 has on the underside of its top wall 56 a forwardly extending integrally molded tongue 100. Adjacent the shroud front end 57 the tongue has a cross element 102 with outward wings to form the shape of a "T". Extending up from the center of the "T" is a hook 104 having a rearwardly facing barb.

As described, the locking means for the shroud includes the cross element 102 the hook 104 and the rearward margin of the opening 78 in the top wall of the nozzle cap 62.

In the assembly of the shroud onto the pump body with the nozzle cap/trigger unit already attached (FIGS. 5A through 5D) the open front 58 of the shroud is positioned to approach the body from the rear. The shroud is moved forward and the tongue 100 moves between the rails 90 with the cross element 102 over the rails. As the shroud is pressed farther forward, the shoulder 60 at the rear of the shroud slides under the shelf 33.

Figure 5B:
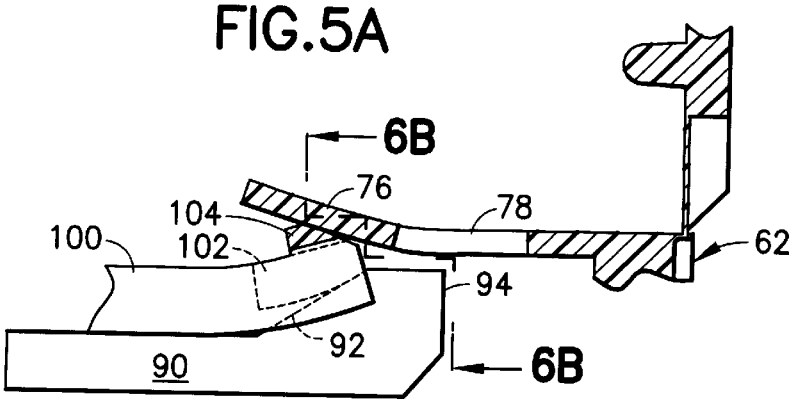
Figure 5C:
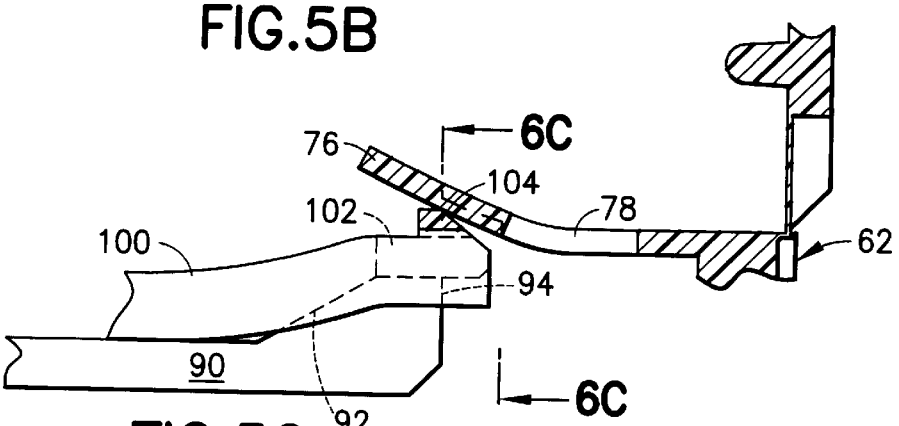
Figure 5D:
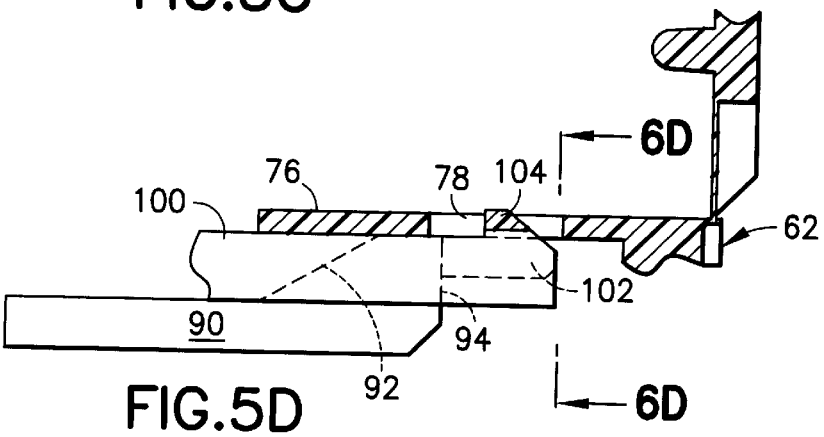
Figure 6A:
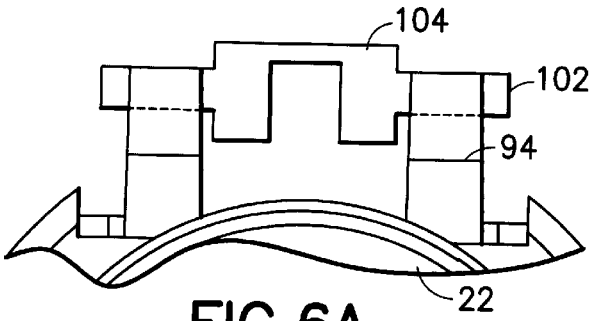
FIGS. 6A, B, C and D are enlarged sectional views taken on the section lines 6A—6A; 6B—6B; 6C—6C; 6D—6D from FIGS. 5A, 5B, 5C, and 5D respectively.
Figure 6B:
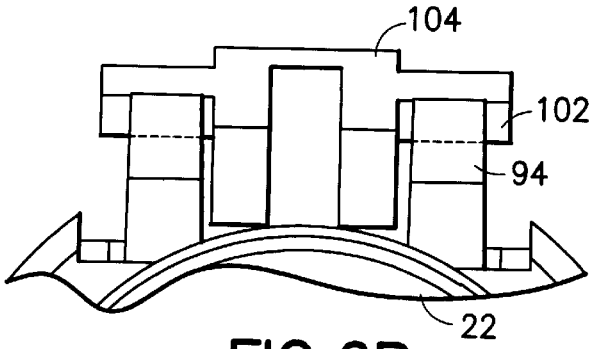
Figure 6C:
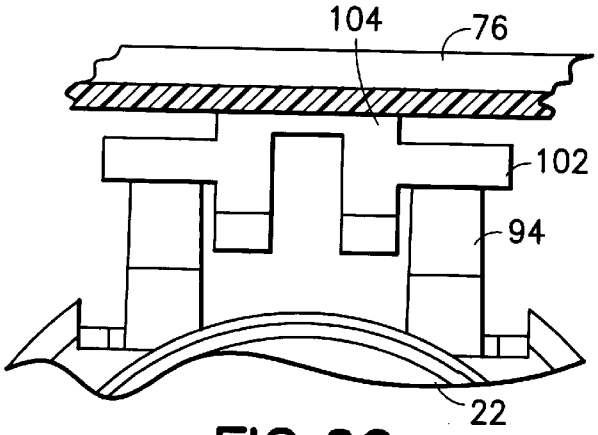
Figure 6D:
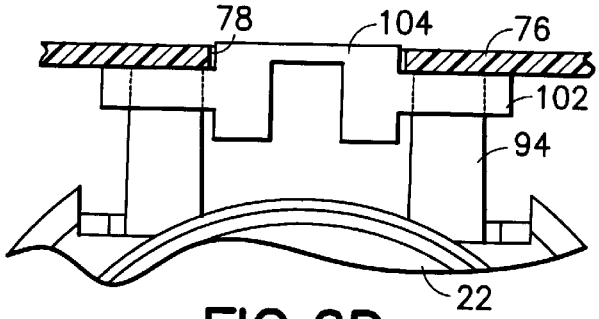

At a farther point in the travel of the shroud, the crosspiece 102 engages the inclines 92 and moves upward encountering the top wall 76 of the nozzle cap 62, flexing it upward (FIG. 5B). The crosspiece 102 rides on the incline and then snaps down as it passes the vertical front end of the head. The top wall of the nozzle cap returns to its prior shape.

This leaves the crosspiece 102 blocked from retreat by the front ends 94 and the barb of hook 104 in the opening 78 with its rear face facing the margin of the opening 78. This arrangement holds the shroud in position on the pump body and serves as a lock to keep it from being displaced. By the time of the snapping of the lock, the shoulder 60 has slid snugly under the shelf 33 holding the shroud down against upward displacement.

It will be clear that the lock arrangement disclosed provides a simple snap-action security which, once achieved, cannot be easily displaced. The operation of the dispenser is substantially as disclosed in the von Schuckmann patent.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A pump dispenser comprising:

a. a pump body having a top wall and a nozzle fitting at the front end thereof, the top wall having adjacent its front end an upstanding rail portion having a vertical front and a forward and upward incline spaced back from the front end, b. an open-fronted shroud having a top wall and a tongue extending forward from the top wall, the tongue having a lateral wing adjacent its front end with a rear surface of the wing abutting the front end of the rail portion and having an upward wedge-shaped hook defined by an inclined front end above the wing, and c. a nozzle cap having a rearward recess receiving the nozzle fitting and having a resilient top wall portion formed with a hook opening receiving the wedge-shaped hook.

2. A pump dispenser comprising:

a. a pump body having a horizontal top wall and a nozzle fitting at the front end thereof, the top wall having a pair of spaced parallel rails extending therealong, the rails having vertical front and upward inclines adjacent the front ends, b. an open-fronted shroud having a top wall and a tongue extending forward from the top wall, the tongue having lateral wings, the tongue extending between the rails with rear surfaces thereon abutting the front ends of the rails and having a central upward wedge-shaped hook defined by an inclined front end above the wings, and c. a nozzle cap having a rearward recess receiving the nozzle fitting and having a resilient top wall portion formed with a latch opening receiving the wedge-shaped hook.

3. A pump dispenser comprising:

a. a pump body having a horizontal top wall and a nozzle fitting at the front end thereof, the top wall having a pair of spaced parallel rail portions, the rail portions having vertical fronts and forward and upward inclines adjacent the front ends, b. an open-fronted shroud having a top wall and an elongate resilient tongue extending forward from the top wall, the tongue having lateral wings, the tongue extending between the rail portions with rear surfaces of the wings abutting the front ends of the rails and having a central upward wedge-shaped hooks having an inclined front end, and c. a nozzle cap having a rearward recess receiving the nozzle fixture and having a resilient top wall portion having an opening receiving the wedge-shaped hook.

4. A pump dispenser as claimed in claim 3 wherein the nozzle cap has a trigger lever hingedly connected hereto.

5. A pump dispenser as claimed in claim 3 wherein the shroud is formed with an inward shoulder spaced above the lower end thereof and the body has a rearward shelf spaced below the upper end thereof and the shoulder is snugly disposed below the shelf.

6. A method of making a pump dispenser comprising the steps of:

a. providing a pump body having a top wall and a nozzle fitting at the front end thereof, the top wall having at least one rail extending there-along, the rail having a vertical front and an upward incline adjacent the front end, b. providing an open-fronted shroud having a top wall and an elongate resilient tongue extending forward from the top wall, the tongue having at least one lateral wing, and having a central upward wedge-shaped hook, c. providing a nozzle cap having a rearward recess receiving the nozzle fitting and having a resilient top wall portion formed with a hook opening, d. sliding the shroud forward over the body with the tongue extending along the rail, e. engaging the incline with the wing and engaging the top wall of the nozzle cap with the tongue, and f. distorting the top wall of the nozzle cap upward to permit the wing to pass over the incline and snap down to abut against the vertical front of the rail as the top wall of the nozzle cap to return to original shape and the hook enters the opening.

* * * * *